US005692720A

United States Patent [19]

Griggs

[11] Patent Number: 5,692,720

[45] Date of Patent: Dec. 2, 1997

[54] ANCHORING DEVICE FOR UMBRELLAS

[76] Inventor: George J. Griggs, 90 Center St., Gibbstown, N.J. 08027

[21] Appl. No.: 583,677

[22] Filed: Jan. 5, 1996

[51] Int. Cl.[6] ..... F16M 13/00

[52] U.S. Cl. ..... 248/530; 248/512; 135/20.1; 135/15.1

[58] Field of Search ..... 248/530, 512, 248/519, 534; 135/15.1, 16, 20.1, 27; 403/362, 403, 205, 382; 52/165

[56] References Cited

U.S. PATENT DOCUMENTS

| | | | |
|---|---|---|---|
| 970,751 | 9/1910 | Pranke | 135/16 |
| 1,261,213 | 4/1918 | Clay | 403/205 |
| 1,308,630 | 7/1919 | Hatch | 248/156 |
| 2,441,109 | 5/1948 | Carlson . | |
| 2,628,797 | 2/1953 | Campomar | 248/43 |
| 2,905,187 | 9/1959 | Croce | 135/20.1 |
| 3,362,419 | 1/1968 | Feyerherm | 135/15.1 |
| 3,765,434 | 10/1973 | Riggs | 135/16 |
| 4,753,411 | 6/1988 | Lechner et al. | 248/533 |
| 4,832,304 | 5/1989 | Morgulis | 248/533 |
| 4,850,564 | 7/1989 | Padin | 248/533 |
| 4,887,786 | 12/1989 | Stokes | 248/512 |
| 5,046,699 | 9/1991 | Perreault et al. | 248/533 |
| 5,088,681 | 2/1992 | Procaccianti et al. | 248/530 |
| 5,098,057 | 3/1992 | Gran et al. | 248/530 |
| 5,174,534 | 12/1992 | Mitchell | 248/311.2 |
| 5,271,196 | 12/1993 | Fanti | 52/166 |
| 5,339,847 | 8/1994 | Kanter et al. | 135/20.1 |
| 5,431,364 | 7/1995 | Etter | 248/534 |
| 5,533,295 | 7/1996 | Hochberger | 248/512 |

FOREIGN PATENT DOCUMENTS

| | | | |
|---|---|---|---|
| 1062753 | 3/1967 | United Kingdom | 135/20.1 |

*Primary Examiner*—Leslie A. Braun
*Assistant Examiner*—Kimberly Wood
*Attorney, Agent, or Firm*—Norman E. Lehrer

[57] ABSTRACT

An anchoring device for supporting two umbrellas, which each include a shaft, above the ground. The anchoring device includes a vertical tubular member that has an upper end and a lower end in the form of a pointed tip. The shaft of one of the umbrellas is slidably receivable in the vertical tubular member through the upper end thereof. A horizontal tubular member extends perpendicularly from the vertical tubular member and has a distal end. The shaft of another umbrella is slidably receivable in the horizontal tubular member through distal end thereof.

18 Claims, 2 Drawing Sheets

ANCHORING DEVICE FOR UMBRELLAS

BACKGROUND OF THE INVENTION

The present invention is directed toward an anchoring device for umbrellas and, more particularly, to such a device that can be readily and securely mounted in the ground in order to support two umbrellas above the same.

It is a common custom for beach goers to utilize an umbrella in order to shield themselves from the harsh rays of the sun. Typically, the umbrella is secured in place by driving the bottom of the umbrella shaft into the ground. While such a method may be adequate in still air, there are usually relatively severe winds at the beach. The strong winds often cause the beach umbrellas to be lifted out of the sand and carried away. Besides inconveniencing the owner of the umbrella, the removal and subsequent floating away of the umbrella can pose a severe hazard to others due to the fact that beach umbrellas often have pointed tips.

In recognition of the foregoing, numerous supports have been developed which are used to better secure beach umbrellas into the sand. While some existing supports sufficiently protect beach goers from the harmful rays of the sun, none adequately shield against both the sun and the strong winds that one often encounters at the beach.

Another problem with existing supports for beach umbrellas is that they can be readily displaced from the sand. By way of example, U.S. Pat. Nos. 2,441,109, 2,628,797, 4,832,304, 5,046,699 and 5,098,057 each discloses an umbrella support with an "auger" type tip which is threaded into the sand. Such supports can be easily uprooted since substantial space can be formed around the tip of the support during its installation.

SUMMARY OF THE INVENTION

The present invention is designed to overcome the deficiencies of the prior art discussed above. It is an object of the present invention to provide an anchoring device that can be readily and securely mounted in the ground.

It is a further object to provide such an anchoring device that can support two umbrellas in order to protect a beach goer from both the sun and the wind.

It is yet another object of the invention to provide such an anchoring device that can securely engage umbrellas with shafts of varying diameters.

In accordance with the illustrative embodiments, demonstrating features and advantages of the present invention, there is provided an anchoring device for supporting two umbrellas above the ground. The anchoring device includes a vertical tubular member that has an upper end and a lower end in the form of a pointed tip. The shaft of one of the umbrellas is slidably receivable in the vertical tubular member through the upper end thereof. A horizontal tubular member extends perpendicularly from the vertical tubular member and has a distal end. The shaft of another umbrella is slidably receivable in the horizontal tubular member through the distal end thereof.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
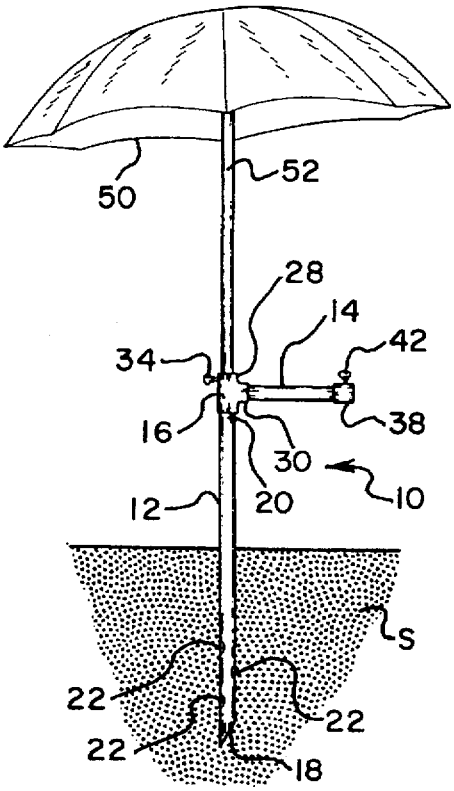
FIG. 1 is an elevational view of the anchoring device of the present invention with an umbrella secured thereto.

Referring now to the drawings in detail wherein like reference numerals have been used throughout the various figures to designate like elements, there is shown in the figures an anchoring device for umbrellas constructed in accordance with the principles of the present invention and designated generally as 10.

The anchoring device 10 essentially includes a vertical tubular member 12, a horizontal tubular member 14 and a T-shaped coupling 16. Members 12 and 14 and the T-shaped coupling are preferably comprised of polyvinyl chloride. However, they can be comprised of metal or a variety of other plastic and composite materials.

The vertical tubular member 12 includes a pointed or tapered tip 18 and an upper end 20, located distally from the tapered tip. The vertical tubular member preferably is 36 inches (91.44 cm) long and has a 1.25 inch (3.175 cm) inner diameter. A plurality of holes 22 (FIGS. 1 and 2) are formed adjacent the tapered tip 18 in order to facilitate the mounting of the device 10 into the ground as more fully described below. Each hole 22 preferably has a 1 inch (2.54 cm) diameter.

Figure 4:
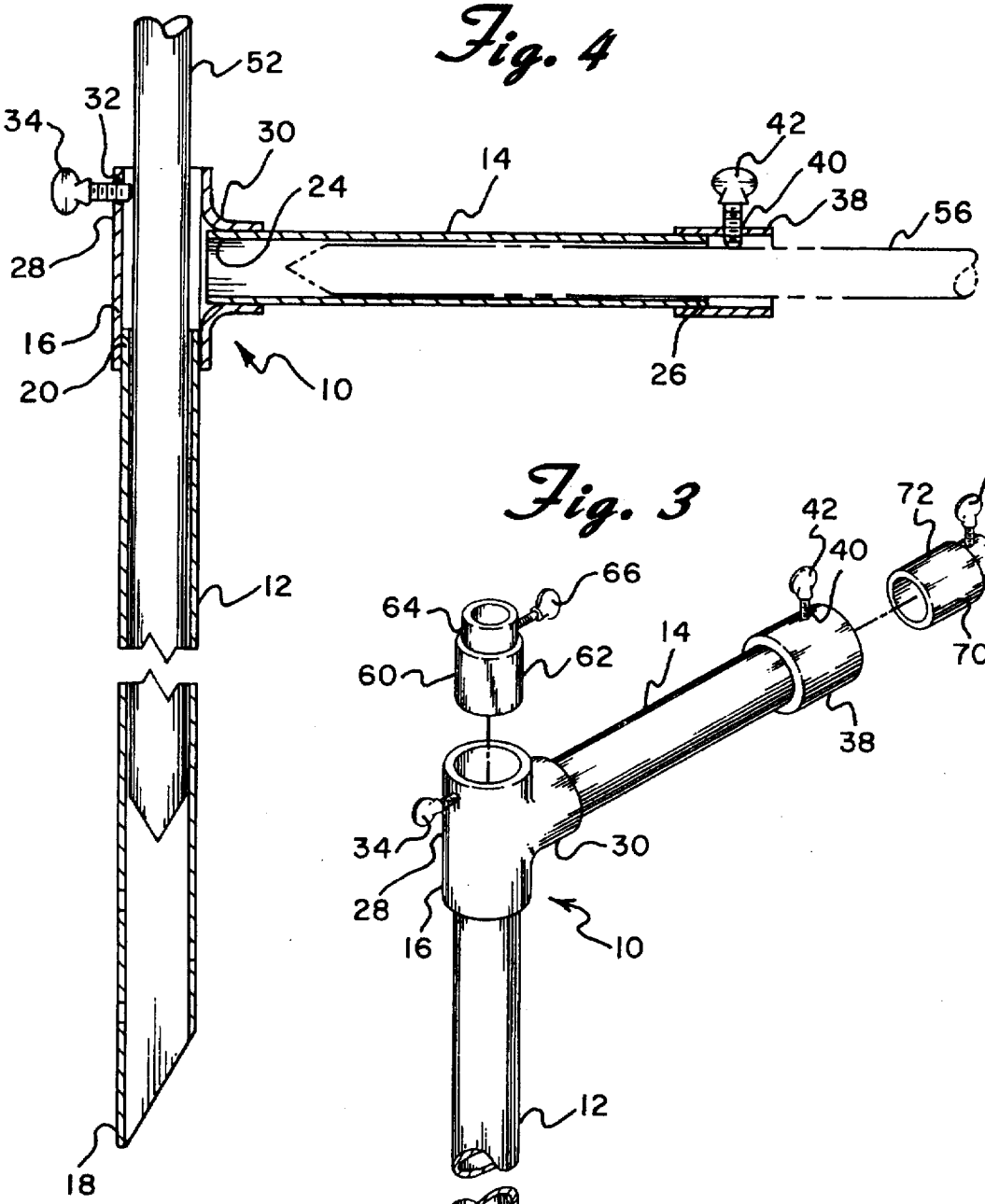
FIG. 4 is a cross-sectional view of the anchoring device shown with two umbrella shafts secured thereto.

The horizontal tubular member 14 includes a first end 24 and a second or distal end 26 as best illustrated in FIG. 4. The horizontal tubular member is preferably 9 inches (22.86 cm) long and has a 1.25 inch (3.175 cm) inner diameter.

The T-shaped coupling 16 includes a vertical portion 28 and a horizontal portion 30, which extends perpendicularly from the center of the vertical portion. The bottom of the vertical portion 28 is preferably friction fitted over the upper end 20 of the vertical tubular member 12. The first end 24 of the horizontal member 14 is friction fitted in the horizontal portion of the coupling 16. It should be noted that the T-shaped coupling 16 can be secured to the vertical and horizontal tubular members in a number of different ways.

Figure 3:
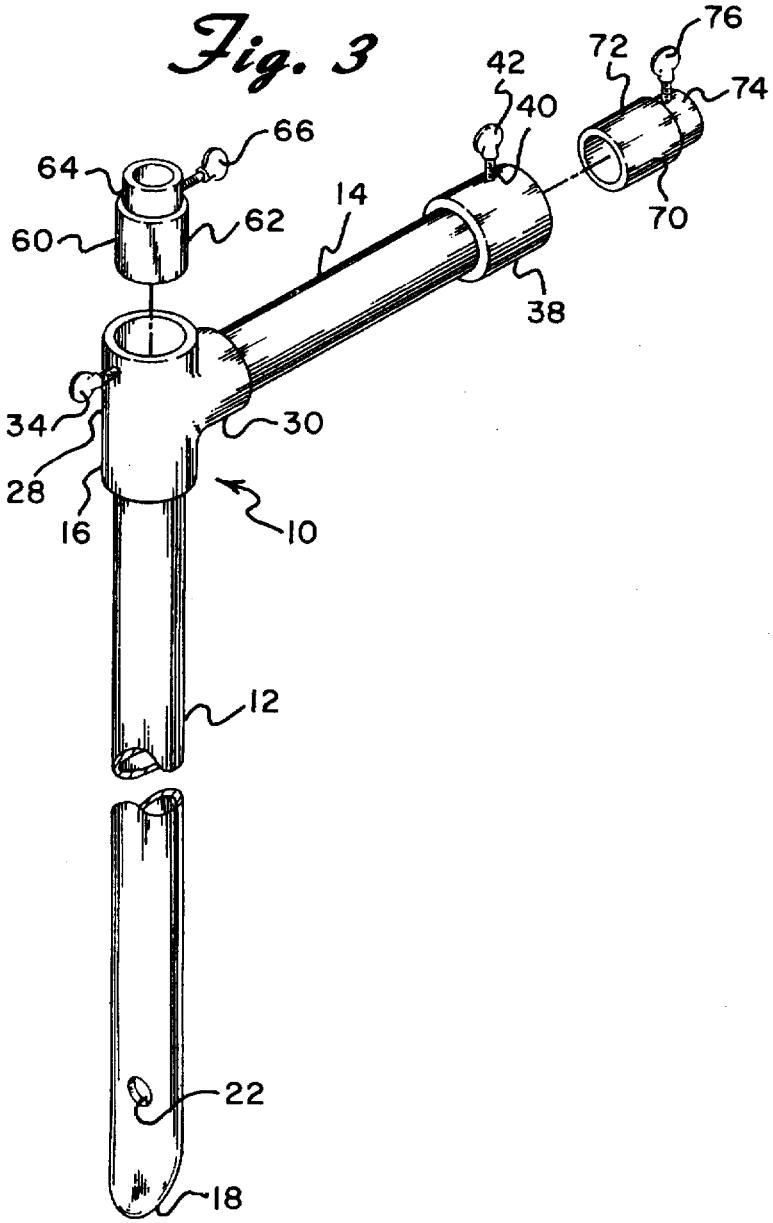
FIG. 3 is a perspective view of the anchoring device of the present invention.

Referring to FIGS. 3 and 4, an opening 32 is formed through the vertical portion 28 of the T-shaped coupling 16. A thumb screw 34 is threaded through the opening 32 in order to engage the shaft of an umbrella as more fully described below.

A secondary coupling 38 is preferably friction fitted over the distal end 26 of the horizontal tubular member 14. The coupling 38 has an opening 40 formed therethrough. A thumb screw 42 is threaded through the opening 32 in order to engage a shaft of a second umbrella as more fully described below.

Figure 2:
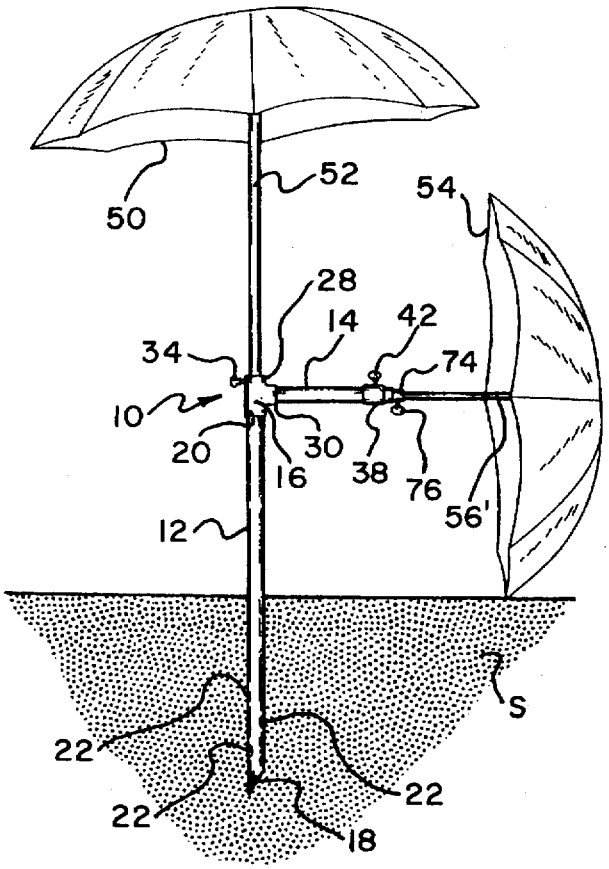
FIG. 2 is a view similar to FIG. 1 showing two umbrellas secured thereto.

In order to facilitate an understanding of the principles associated with the present invention, its operation will now be briefly described. The pointed tip 18 of the vertical tubular member 12 is inserted into the sand S (FIGS. 1 and 2). Such insertion is accomplished by placing the tip 18 on the sand and rotating the horizontal tubular member 14 while applying downward force on the same. As the vertical tubular member is inserted into the ground, sand freely fills the holes 22 which serves to anchor the device in place.

Thereafter, a first umbrella 50, which has a shaft 52 associated therewith, is secured to the device 10. This is accomplished by placing the bottom of the shaft 52 into the T-shaped coupling 16 and sliding the same downward into the vertical tubular member 12. When the desired distance between the umbrella 50 and the beach is obtained, the shaft is secured in place by threading thumb screw 34 into the coupling 16 until it engages the shaft 52 thereby preventing further downward sliding (FIG. 4). The first umbrella shields the beach goer from the harmful rays of the sun.

A second umbrella 54, which includes a shaft 56, is then secured in the device 10 by placing the free end of the shaft 56 into the coupling 38 and sliding the same into the horizontal tubular member 14. The shaft 56 is secured in place by threading thumb screw 42 through the opening 40 in the coupling 38 until it engages the shaft. The second umbrella is preferably positioned to shield the beach goer from the wind.

Figure 5:
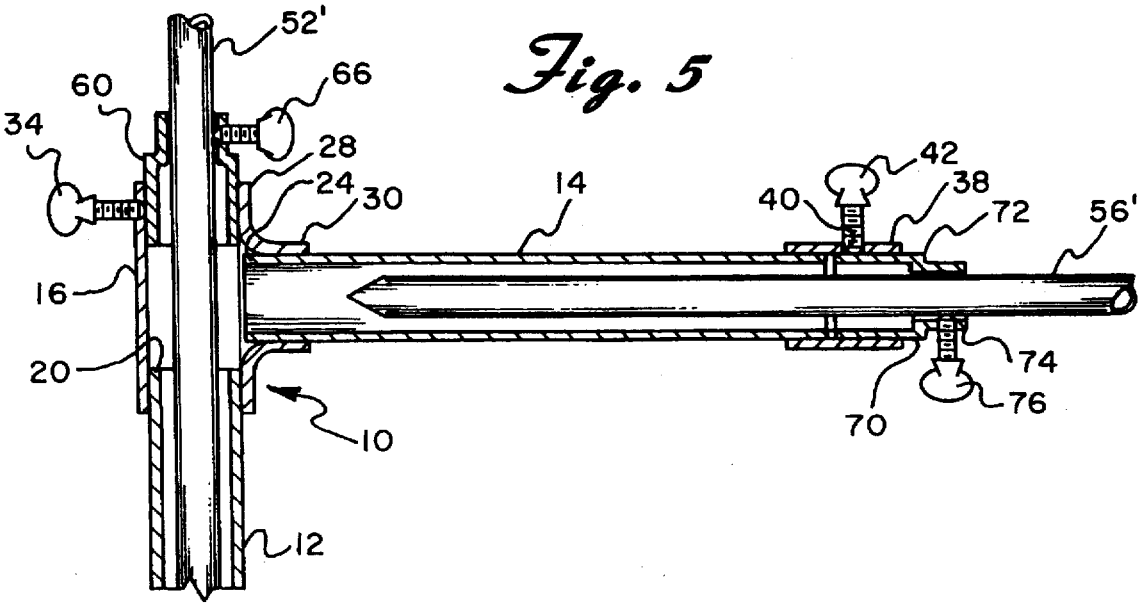
FIG. 5 is a partial cross-sectional view of the anchoring device shown with two small umbrella shafts secured thereto.

Referring to FIGS. 3 and 5, the device 10 preferably includes a first adapter 60 which has a large diameter segment 62 and a small diameter segment 64 (FIG. 3). The large diameter segment 62 is designed to be friction fitted into the top of the vertical portion 28 of the T-shaped coupling 16 so that the small diameter segment 64 extends upwardly from the same. A thumb screw 66 is threaded through an opening in the small diameter segment 64 of the adapter 60. The adapter 60 provides for better securement of an umbrella shaft 52' that has a significantly smaller diameter than the diameter of the vertical portion 28 of the coupling 16 and the diameter of the vertical tubular member 12.

Similarly, a second adapter 70, which has a large diameter segment 72, a small diameter segment 74 and a thumb screw 76 threadably secured through the small diameter segment 74, is preferably included (FIGS. 2, 3 and 5). The large diameter segment 72 of the second adapter 70 is designed to be friction fitted into the coupling 38. Once again, the adapter 70 provides for better securement of an umbrella shaft 56' that has a significantly smaller diameter than the diameter of the coupling 38 and the diameter of the horizontal tubular portion 14.

The present invention may be embodied in other specific forms without departing from the spirit or essential attributes thereof and accordingly reference should be made to the appended claims rather than to the foregoing specification as indicating the scope of the invention.

What is claimed is:

1. A beach umbrella arrangement comprising first and second umbrellas and an anchoring device supporting said first and second umbrellas above the ground, each of said umbrellas having a shaft, said anchoring device comprising:

a vertical tubular member having an upper end and a lower end in the form of a pointed tip, said shaft of said first umbrella being positioned in said vertical tubular member through said upper end thereof;

a horizontal tubular member having a first end and a second end, said shaft of said second umbrella being positioned in said horizontal tubular member through said second end thereof, and means securing said first end of said horizontal tubular member to said vertical tubular member so that said horizontal tubular member extends perpendicularly from said vertical tubular member whereby said pointed tip is adapted to mount said arrangement into the ground.

2. The arrangement of claim 1 wherein said pointed tip of said vertical tubular member has a plurality of holes formed therethrough.

3. The arrangement of claim 1 wherein said vertical and horizontal members are comprised of plastic.

4. The arrangement of claim 1 wherein said vertical tubular member is substantially longer than said horizontal tubular member.

5. The arrangement of claim 1 wherein said vertical member is approximately four times as long as said horizontal member.

6. The arrangement of claim 1 wherein said securing means includes a primary coupling means, said primary coupling means having a vertical portion and a horizontal portion, said vertical portion of said primary coupling means being secured to said vertical tubular member, said first end of said horizontal tubular member being secured in said horizontal portion of said primary coupling means.

7. The arrangement of claim 6 wherein said vertical portion of said primary coupling means has an opening formed therethrough, said arrangement further including a primary screw means, said primary screw means being adapted to be threaded through said opening in said vertical portion of said primary coupling means in order to engage said shaft of said first umbrella.

8. The arrangement of claim 7 further including a secondary coupling means extending outwardly from said second end of said horizontal tubular member, said secondary coupling means having an opening formed therethrough, said arrangement further including a secondary screw means, said secondary screw means being adapted to be threaded through said opening in said secondary coupling means in order to engage said shaft of said second umbrella.

9. The arrangement of claim 8 further including first and second adapter means, each of said adapter means having a large diameter segment and a small diameter segment, said large diameter segment of said first adapter means being secured in said vertical portion of said primary coupling means so that said corresponding small diameter segment extends upwardly therefrom and said large diameter segment, of said second adapter means being secured in said secondary coupling means so that said corresponding small diameter segment extends outwardly therefrom, each of said shafts of said umbrellas being positioned in a corresponding one of said adapter means.

10. The arrangement of claim 9 wherein each of said small diameter segments includes an opening therein and a screw means threaded into said opening for engaging the umbrella shaft positioned within said segment.

11. A beach umbrella arrangement comprising first and second umbrellas and an anchoring device supporting said first and second umbrellas above the ground, each of said umbrellas having a shaft, said anchoring device comprising:

a vertical tubular member having an upper end and a lower end in the form of a pointed tip, said shaft of said first umbrella being positioned in said vertical tubular member through said upper end thereof, and a horizontal tubular member extending perpendicularly from said vertical tubular member and having a distal end, said shaft of said second umbrella being positioned in said horizontal tubular member through said distal end thereof whereby said pointed tip is adapted to mount said arrangement into the ground.

12. The arrangement of claim 11 wherein said vertical and horizontal tubular members are comprised of plastic.

13. The arrangement of claim 11 wherein said vertical tubular member is substantially longer than said horizontal tubular member.

14. The arrangement of claim 11 wherein said pointed tip of said vertical tubular member has a plurality of holes formed therethrough.

15. The arrangement of claim 11 further including means for firmly engaging each of said shafts of said umbrellas.

16. The arrangement of claim 15 wherein said engaging means includes an opening formed in each of said tubular members and a screw associated therewith, each of said screws being adapted to be threaded through its associated opening in order to engage a corresponding one of said shafts.

17. The arrangement of claim 16 further including first and second adapter means, each of said adapter means having a large diameter segment and a small diameter segment, said large diameter segment of said first adapter means being secured in said upper end of said vertical tubular portion so that said small diameter segment extends upwardly therefrom and said large diameter segment of said second adapter means being secured in said distal end of said horizontal tubular segment so that said small diameter segment extends outwardly therefrom, each of said shafts of said umbrellas being positioned in a corresponding one of said adapter means.

18. The arrangement of claim 17 wherein each of said small diameter segments includes an opening therein and a screw means threaded into said opening for engaging the umbrella shaft positioned within said segment.

* * * * *